US007653209B2

(12) United States Patent
Abe et al.

(10) Patent No.: US 7,653,209 B2
(45) Date of Patent: Jan. 26, 2010

(54) SPEAKER APPARATUS

(75) Inventors: Yasuhisa Abe, Yamagata (JP); Hiroyuki Kobayashi, Yamagata (JP)

(73) Assignees: Pioneer Corporation, Tokyo (JP); Tohoku Pioneer Corporation, Tendo-shi (JP)

( * ) Notice: Subject to any disclaimer, the term of this patent is extended or adjusted under 35 U.S.C. 154(b) by 853 days.

(21) Appl. No.: 11/375,582

(22) Filed: Mar. 15, 2006

(65) Prior Publication Data

US 2006/0222199 A1 Oct. 5, 2006

(30) Foreign Application Priority Data

Mar. 16, 2005 (JP) ..... 2005-075510

(51) Int. Cl.
*H04R 25/00* (2006.01)

(52) U.S. Cl. ..... 381/414; 381/396; 381/412

(58) Field of Classification Search ..... 381/396, 381/398, 400, 412–414
See application file for complete search history.

(56) References Cited

U.S. PATENT DOCUMENTS 6,774,510 B1 * 8/2004 Moro et al. ..... 381/414
6,801,635 B1 * 10/2004 Minami et al. ..... 381/396
7,031,489 B2 * 4/2006 Amino ..... 381/414
7,088,841 B2 * 8/2006 Kallen ..... 381/396
7,289,642 B2 * 10/2007 Chen ..... 381/396

FOREIGN PATENT DOCUMENTS

| | | | |
|---|---|---|---|
| JP | 63-200995 | U | 12/1988 |
| JP | 05-168092 | A | 7/1993 |
| JP | 5-74094 | U | 10/1993 |
| JP | 6-327095 | A | 11/1994 |
| JP | 7-170597 | A | 7/1995 |
| JP | 7-170598 | A | 7/1995 |
| JP | 8-116590 | A | 5/1996 |
| JP | 10-155198 | A | 6/1998 |
| JP | 2003-219494 | A | 7/2003 |

* cited by examiner

*Primary Examiner*—Suhan Ni
(74) *Attorney, Agent, or Firm*—Foley & Lardner LLP

(57) ABSTRACT

A speaker apparatus includes at least one of an inner flux applicator and an outer flux applicator includes an annular first member and an annular second member. The first member having a first surface that faces toward the magnetic gap, the first member satisfying L1>W1 where L1 is a length of the first surface in a direction parallel to the central axis and W1 is a width of the first member in a direction orthogonal to a central axis. The second member is magnetically coupled with the first member and arranged on an outer side of the first member, the second member satisfying W2>L2 where W2 is a width of the second member in a direction orthogonal to a central axis and L2 is a length of the second surface in a direction parallel to the central axis, and L1>L2.

20 Claims, 7 Drawing Sheets

SPEAKER APPARATUS

BACKGROUND OF THE INVENTION

1. Field of the Invention

The present invention generally relates to a speaker apparatus. The present invention specifically relates to a speaker apparatus having a flux applicator that applies magnetic flux to a voice coil arranged in a magnetic gap.

2. Description of the Related Art

In a so-called external magnet speaker apparatus, a center pole is disposed at the center of the apparatus, a ring magnet that is a permanent magnet is coaxially disposed around the center pole, and a top plate that forms a magnetic circuit along with the ring magnet is disposed on the ring magnet. Thus, a magnetic gap is formed between the top plate and the center pole. A voice coil is arranged in the magnetic gap such that the voice coil can vibrate. The voice coil is connected to a diaphragm. When audio signal current is supplied to the voice coil while the voice coil is applied with magnetic flux via the top plate, the diaphragm vibrates whereby voice and sound are reproduced.

The top plate and the center pole configure a flux applicator that applies the magnetic flux to the voice coil. The top plate disposed radially outside the voice coil configures an outer flux applicator, and the center pole disposed inside the voice coil configures an inner flux applicator.

It is necessary that the length of the magnetic gap along the direction of vibration of the voice coil be longer than a stroke of the voice coil. Therefore, the top plate requires an opposing surface with a prespecified length in the direction of vibration of the voice coil i.e., axial direction of the center pole. Namely, the top plate requires a prespecified thickness in the axial direction. Especially, a bass speaker apparatus, which has a longer stroke, requires a magnetic circuit having a longer opposing surface. Namely, a so-called long-gap magnetic circuit is required.

On the contrary, there has been proposed a technique of forming an opposing surface by just using a thicker top plate. However, a thicker top plate makes the speaker apparatus heavier, bigger, and costlier.

One approach is to punch a ring part from a soft magnetic material thin plate and bend the inner edge of the ring part to be double to obtain a top plate having the required thickness. A conventional technology has been disclosed in, for example, Japanese Patent Publication No. HEI5-168092. This approach may solve the issues of higher weight and bigger size of the apparatus; however, it does not solve the issue of higher costs because it requires technically difficult machining processes to be carried out.

Moreover, in the conventional speaker apparatus, a large amount of heat is generated due to vibrations of the voice coil. The heat is conducted to the opposing top plate and heats up the top plate. A hot top plate can cause malfunctions thereby reducing the durability of the apparatus. Therefore, there is a need to appropriately release the heat. The issue of the heat becomes severe in a bass speaker apparatuses, in which high currents are applied to the voice coil, and in in-vehicle speaker apparatuses, which are placed in a small space.

SUMMARY OF THE INVENTION

It is an object of the present invention to at least solve the problems in the conventional technology.

According to an aspect of the present invention, a speaker apparatus includes a permanent magnet and a magnetic circuit, the magnetic circuit including an annular inner flux applicator and an annular outer flux applicator, the inner flux applicator and the outer flux applicator being arranged coaxially around a central axis and having a magnetic gap therebetween; a voice coil arranged in the magnetic gap around the central axis, the voice coil being supported such that the voice coil can vibrate when the inner flux applicator and the outer flux applicator produce a magnetic flux in the magnetic gap; and a diaphragm coupled to the voice coil, the diaphragm being supported such that the diaphragm can vibrate when the voice coil vibrates. At least one of the inner flux applicator and the outer flux applicator includes an annular first member having a first surface that faces toward the magnetic gap, the first member satisfying $L1>W1$ where $L1$ is a length of the first surface in a direction parallel to the central axis and $W1$ is a width of the first member in a direction orthogonal to a central axis; an annular second member that is magnetically coupled with the first member and arranged on an outer side of the first member, the second member satisfying $W2>L2$ where $W2$ is a width of the second member in a direction orthogonal to a central axis and $L2$ is a length of the second surface in a direction parallel to the central axis; and $L1>L2$.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
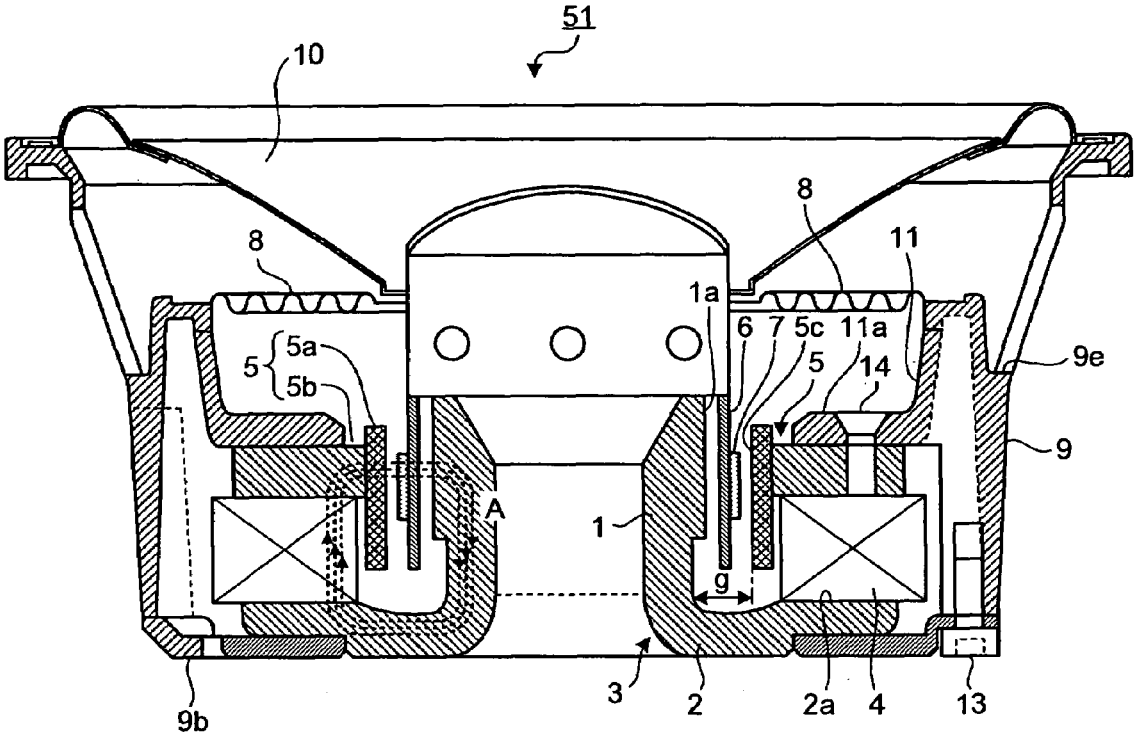
FIG. 1 is a vertical cross-section of a speaker apparatus according to a first example of the present invention.

Exemplary embodiments of the present invention will be described below with reference to accompanying drawings; however, the present invention is not limited by the embodiments.

A so-called external magnet speaker apparatus will be explained below as a speaker apparatus according to a first embodiment of the present invention. The speaker apparatus includes a ring magnet as a permanent magnet that generates magnetic flux. The speaker apparatus further includes a center pole as an annular inner flux applicator and a top plate as an annular outer flux applicator. The ring magnet, the center pole, and the top plate configure a magnetic circuit. A magnetic gap (of the magnetic circuit) is formed between an outer peripheral surface of the center pole and an inner peripheral surface of the top plate.

Namely, the magnetic circuit includes the long cylindrical center pole, the annular ring magnet coaxially disposed around the center pole, and the top plate coaxially disposed around the center pole, and a magnetic gap is formed between the outer surface of the center pole and the inner surface of the top plate.

A voice coil is disposed in the magnetic gap. The voice coil is held in the magnetic gap in such a manner that the voice coil can vibrate parallel to the axis of the center pole. A diaphragm is connected to one end of the voice coil. The center pole and the top plate apply magnetic flux to the voice coil. When a current corresponding to an audio signal is applied to the voice coil, the diaphragm vibrates thereby reproducing voice and/or sound corresponding to the audio signal. The top plate is configured with a first member that is substantially cylindrical and a second member that extends radially outward, i.e., away from the longitudinal axis of the first member, from the periphery of the first member.

The first member is annular in a cross section taken along a direction orthogonal to its longitudinal axis. The inner surface of the first member (hereinafter, "magnetic gap opposing surface") faces toward the magnetic gap. The first member satisfies L1>W1, where L1 is the length of the first member along its longitudinal axis and W1 is the thickness of the wall of the first member. The second member is also annular in a cross section taken along a direction orthogonal to its longitudinal axis. The second member is magnetically coupled with the first member, and satisfies W2>L2, where W2 is the thickness of the wall of the second member and L2 is the length of the second member along the longitudinal axis of the second member. The lengths of the first and second members satisfy L1>L2.

Namely, the first member is cylindrical and it is elongated along its longitudinal axis. The inner surface of the first member, i.e., the magnetic gap opposing surface, faces toward the magnetic gap. On the other hand, the second member is like a ring.

Namely, the top plate has a T-shaped profile in a cross section, taken at the center and along a direction parallel to longitudinal axis of the first and second members. As a result, the surface area of the magnetic gap opposing surface can be increased without increasing the material. Moreover, because the top plate has a simple structure with a lateral bar, which is the second member, and a vertical bar, which is the first member, the top plate can be machined relatively easily. Therefore, according to the present embodiment, it is possible to configure an efficient speaker apparatus at a lower cost.

The length (first length) of a part of the first member extending from the second member in the direction of the diaphragm is shorter than the length (second length) extending away from the diaphragm. As a result, the length of the first member along its longitudinal axis can be made shorter.

The first and second members engage with each other through an engaging section. As a result, the first and second members can be easily and firmly positioned and the magnetic coupling between the first and second members can be surely achieved.

Heat is generated in the voice coil and the top plate. A heat radiator, which is made of material having a high thermal conductivity, is provided at an open end of the top plate. The heat radiator is thermally coupled with the top plate and radiates the heat generated in the top plate. The heat radiator also plays a role of a securing member that secures the top plate to a frame.

The outer flux applicator is a part of the magnetic circuit, which applies magnetic flux to the voice coil, that is disposed on the outer side of the magnetic gap with respect to the central axis of the speaker apparatus. Although not limited to, the outer flux applicator is the top plate in an external magnet speaker apparatus, or an outer yoke in the internal magnet speaker apparatus described later.

In the present specification, two materials are said to be magnetically coupled when one of them receives magnetic flux and the other passes the magnetic flux. To be magnetically coupled, the two materials can physically contact each other, or there can be a layer of magnetic material, such as magnetic adhesive, between them. Moreover, the side of a material that is not supported, i.e., that is free, is called a free side. More specifically, the side of the top plate that protrudes away from the permanent magnet is the free side. Also, the side of the yoke that protrudes away from a bottom yoke is the free side.

Two materials are said to be thermally coupled when one of them receives heat and the other passes the heat. To be thermally coupled, the two materials can physically contact each other, or there can be a layer of magnetic material, such as magnetic adhesive, between them. "Covering shape" refers to a condition that a certain material extends along a surface of another material, including both conditions that both materials are in and out of contact. Further, "material with high thermal conductivity" refers to what is more thermally conductive than the air. Further, a fastening unit refers to a screw, a screw spike, a rivet, a nail, or a bolt.

In the speaker apparatus according to a second embodiment of the present invention, the top plate is substantially L-shaped. The top part is made of two members: a lateral member and a vertical member. This configuration allows the surface area of the magnetic gap opposing surface to be increased without increasing the material, to machine the plate relatively easily, and to configure an efficient speaker apparatus at a lower cost. The length (first length) of a part of the vertical member that extends from the second member toward the diaphragm is shorter than the length (second length) that extends away from the diaphragm, and the first length is zero. Therefore, the axial size of the magnetic circuit can be further reduced, and the speaker apparatus can be made compact.

A third embodiment of the present invention relates to a case where a heat radiator is provided in the external magnet speaker apparatus.

The speaker apparatus according to the third embodiment includes a center magnet as the permanent magnet. Furthermore, the speaker apparatus includes a top plate as the annular inner flux applicator and an outer yoke as the annular outer flux applicator. The center magnet, the top plate, and outer yoke configure the magnetic circuit. There is a magnetic gap between the top plate and the outer yoke form.

A heat radiator is provided at the free end of the outer yoke. A sub-outer yoke with smaller diameter than that of the outer yoke is provided at the free end of the outer yoke to form a step section, and the heat radiator is disposed so as to cover the step section. As a result, thermal coupling between the heat radiator and the outer yoke can be increased. The free end of the outer yoke gets heated by the heat generated in the voice coil; however, the heat is efficiently released by the heat radiator.

Concrete examples of the present invention are explained below with reference to the accompanying drawings.

Figure 2:
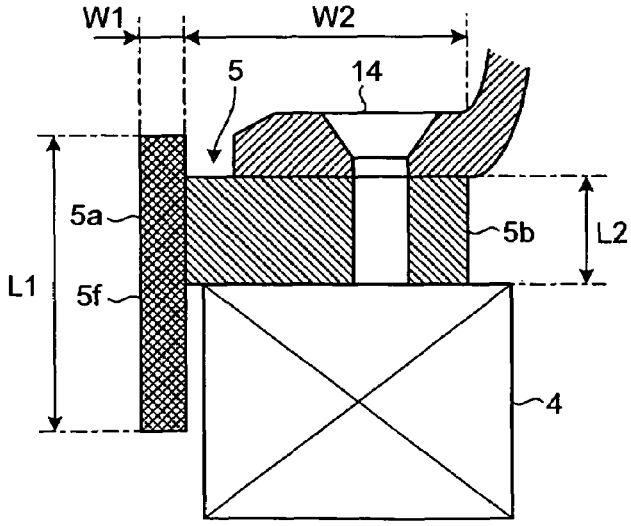
FIG. 2 is an enlarged view of a portion adjacent to a top plate of the speaker apparatus shown in FIG. 1.

FIG. 1 is a vertical cross-section of a speaker apparatus 51 according to a first example of the present invention. FIG. 2 is an enlarged view of a portion adjacent to a top plate of the speaker apparatus 51. The speaker apparatus 51 includes a yoke 3 that includes a center pole 1, a bottom yoke 2, a ring magnet 4 that is a permanent magnet arranged coaxially around the center pole 1, and a top plate 5 that is likewise arranged coaxially around the center pole 1 and that configures the outer flux applicator. The yoke 3, the ring magnet 4, and the top plate 5 form a magnetic circuit that generates magnetic flux A (indicated with broken lines only in the left side in FIG. 1). A portion of the center pole 1 that opposes the top plate 5, which configures the outer flux applicator, configures the inner flux applicator. A magnetic gap g is formed between an outer surface 1*a* of the inner flux applicator and an inner surface 5*c* of the top plate 5. The top plate 5 is made of two members: a first member 5*a* and a second member 5*b*.

The speaker apparatus 51 further includes a voice coil bobbin 6 in the magnetic gap g. A voice coil 7 is wound around the voice coil bobbin 6. The voice coil bobbin 6 is supported with a spider 8 as a damper from a frame 9, to be allowed to vibrate axially along the center pole 1. A diaphragm 10 is connected to the voice coil bobbin 6. A heat radiator 11 is arranged on a side of the top plate 5 that faces toward the diaphragm 10. The heat radiator 11 fixes the top plate 5 and also functions to release heat when the top plate 5 becomes hot.

The yoke 3 is arranged in the center of the speaker apparatus 51. The yoke 3 is made from a magnetic material, such as iron, and configured by two integral parts: the center pole 1 and the bottom yoke 2. The center pole 1 is standing in the center of the speaker apparatus 51, it is cylindrical, and has a substantial thickness. The bottom yoke 2 is a radial extension extending radially outward from the base end of the center pole 1 away from the diaphragm 10. On a surface of the outer circumference of the bottom yoke 2 facing to the diaphragm 10, a flat section 2*a* is formed to place the ring magnet 4, which is a permanent magnet.

On the flat section 2*a* of the bottom yoke 2, the ring magnet 4 that has a short, thick, cylindrical shape and a rectangular radial cross-section, is placed coaxially around the center pole 1. On a further side of the ring magnet 4 closer to the diaphragm 10, the top plate 5 is also placed likewise coaxially around the center pole 1.

The top plate 5 is made from a magnetic plate such as iron. The top plate 5 is configured with the axially extending cylindrical first member 5*a*, and the disk-shaped second member 5*b* that has a large diameter hole and that is arranged outside the first member 5*a*. The first member 5*a* is cylindrical and is substantially thin with a large diameter having an elongate rectangular shape as the radial cross-sectional profile, and axially extends with keeping a radially uniform thickness. The second member 5*b* is a disk that forms a thin flat ring shape having an elongate rectangular shape as the radial cross-sectional profile, and radially extends with keeping an axially uniform thickness. As shown in FIG. 2, the first member 5*a* forms a magnetic gap opposing surface 5*f* on the inner surface 5*c* so that the magnetic gap opposing surface 5*f* is opposed to the magnetic gap g, where an axial dimension L1 of the magnetic gap opposing surface 5*f* is larger than a radial dimension W1 in the radial cross-sectional profile. On the other hand, a radial dimension W2 of the second member 5*b* is larger than an axial dimension L2 in the radial cross-sectional profile.

The first member 5*a* and the second member 5*b* are adhered with an adhesive (not-shown) that is applied between the outer circumferential surface of the first member 5*a* and the inner circumferential surface of the second member 5*b*. The second member 5*b* directly placed on the ring magnet 4 is adhered to the ring magnet 4 with an adhesive, and the first member 5*a* is adhered on the second member 5*b*. On a further side of the top plate 5 closer to the diaphragm 10, arranged is the heat radiator 11 made from aluminum, which has high thermal conductivity and is a nonmagnetic material. The heat radiator 11 has to be nonmagnetic to avoid disturbing the magnetic circuit.

The heat radiator 11 is formed by extending a part of the inner side of the frame 9 until an open end surface of the second member 5*b*, which is in contact over surface with an end surface contact section 11*a* formed at the end of the heat radiator 11. The end surface contact section 11*a* is axially bored with a perforated hole, and at the corresponding position on the second member 5*b*, a thread hole is threaded, so that the heat radiator 11 is secured by fastening a bolt 14 inserted into the thread hole onto the second member 5*b*. The heat radiator 11 is a securing unit that secures the top plate 5 onto the ring magnet 4, as well as a heat releasing unit that releases heat from the top plate 5.

Between the outer surface 1*a* of the center pole 1 and the inner surface 5*c* of the top plate 5, the magnetic gap g formed with a distance in the radial direction is generated all around the circumference. The magnetic gap g extends axially along the outer circumferential surface of the center pole 1. Precisely, the magnetic gap g is formed in a cylindrical shape. Within the magnetic gap g, one end of the thin, long, cylindrical voice coil bobbin 6 is inserted and arranged. The voice coil 7 is wound on the outer circumferential surface at the position corresponding to the magnetic gap g of the cylindrical voice coil bobbin 6. The voice coil bobbin 6 is supported by the spider 8 of a damper from the frame 9. This allows the voice coil 7 to vibrate axially along the center pole 1 within the magnetic gap g. To the other end of the voice coil bobbin 6, connected is the small diameter end of the diaphragm 10 in a so-called cone-shape. The frame 9 forms a cylindrical shape widening in a slightly tapering manner, and is threaded with thread holes at circumferentially regular intervals on the bottom edge to be passed through with bolts 13. A securing plate that supports the yoke 3 from the back side is fastened onto the frame 9 with the bolts 13.

The ring magnet 4 generates the magnetic flux A within the magnetic circuit by its own magnetic force. The magnetic flux A generates the magnetic gap g between the outer surface 1*a* of the center pole 1 and the inner surface 5*c* of the top plate 5. Under the magnetic flux A being generated, when the voice coil 7 arranged in the magnetic gap g is fed with a current of an audio signal, according to Fleming's left-hand rule, the voice coil 7 vibrates. Accompanying this, the diaphragm 10 connected to the voice coil 7 is driven to reproduce sound. In the speaker apparatus 51, because the magnetic gap opposing surface 5*f* is axially long, there is no problem if amplitude of the voice coil 7 becomes large.

The voice coil 7 then vibrates and generates heat. The heat is conducted to the top plate 5 in opposition that is the outer flux applicator, to raise also the temperature of the top plate 5. However, because the heat radiator 11 absorbs heat from the top plate 5 and releases it from its own surface to the ambience as well as conducts heat to the frame 9 to release it from the surface of the frame 9 to the ambience, the temperature of the top plate 5 does not rise to a prespecified temperature or higher. On the other hand, heat in the center pole 1 that is the inner flux applicator is conducted via the bottom yoke 2 to the frame 9 to be released from the surface of the frame 9 to the ambience, so that the temperature of the center pole 1 also does not rise to a prespecified temperature or higher.

As an adhesive that joints the first member 5*a* and the second member 5*b*, a mixture, for example, of a polymer resin adhesive added with a thermally highly conductive material by a uniform proportion can be used. Here, as a thermally highly conductive material, a carbon material, a metal material, and a metal oxide can be used. As a polymer resin adhesive, for example, a polyimide resin, an epoxy resin, an acrylic resin, and a silicon resin adhesive can be used.

Thus, with the speaker apparatus 51, the top plate 5 configuring the outer flux applicator is divided into the first member 5*a* and the second member 5*b*. The first member 5*a* forms an annular shape that includes the magnetic gap opposing surface 5*f* in opposition to the magnetic gap g. The radial cross-sectional profile of the first member 5*a* satisfies L1>W1, where W1 is the radial length, and L1 is the axial length of the magnetic gap opposing surface 5*f*. On the other hand, the second member 5*b* forms an annular shape that is magnetically jointed to the first member 5*a* on its side away from the magnetic gap g. The radial cross-sectional profile of the second member 5*b* satisfies W2>L2, where W2 is the radial length, and L2 is the axial length. The relation between the first member 5*a* and the second member 5*b* is L1>L2, so that the magnetic gap opposing surface in opposition to the magnetic gap can be made larger, without increasing material. A ring magnet opposing surface that can be magnetically jointed to the ring magnet 4 can also be made larger. In addition, dividing into two pieces results in simpler processing, which results in cost reduction.

Furthermore, the first member 5*a* forms a cylindrical shape extending axially, and the second member 5*b* forms a disk shape extending radially, so that simpler processing and thus a further cost reduction can be achieved.

Furthermore, the speaker apparatus 51 includes the heat radiator made from a material with high thermal conductivity to be thermally connected to the second member 5*b*. This results in an increase in the thermal capacity to retain heat by the volume of the heat radiator 11, and in a very rapid conduction of heat retained in the heat radiator 11, so that the heat radiator 11 absorbs heat from the top plate 5 successively and transfers it to other places as well as releases it from its own surface to the ambience. Thus, heat in the top plate 5 can be released efficiently via the heat radiator 11 from the perimeter of the top plate 5 to the ambience. This can suppress a rise in the temperature of the top plate 5 and reduce malfunctions. Also durability is improved.

Furthermore, the heat radiator 11 is also a securing member that is supported from the frame 9 and secures the second member 5*b* onto the ring magnet 4 of a permanent magnet. Therefore, no additional securing member needs to be provided, so that the number of parts can be reduced and a cost reduction can be achieved.

Furthermore, in the speaker apparatus 51, the bottom yoke 2, which is integrally formed with the center pole 1 and extending radially outward from the base end of the center pole 1, areally contacts the bottom surface of the frame 9 and is thermally connected thereto. The bottom yoke 2 is fastened to a bottom 9*b* of the frame 9 with the bolts 13, and thermally connected. This provides sufficient thermal connection between the bottom yoke 2 and the frame 9. As a result, heat generated in the voice coil 7 and the top plate 5 is released from the frame 9 via the center pole 1 so that heat radiation efficiency is further improved. Regarding a path of heat radiation, heat is conducted through two paths including a path via the heat radiator 11 and another path via the center pole 1 to increase heat radiation capacity. Furthermore, because the heat conducted via the two paths is released from the same frame 9 to the ambience, for example, when it is attempted to increase heat radiation efficiency by widening the surface area for heat radiation, providing radiation fins over the frame 9 can improve radiation performance of heat conducted via the two paths, so that cost performance can be improved.

The heat radiator 11 can be made of aluminum or any substance that is nonmagnetic and has high thermal conductivity. The heat radiator 11 can be made of, for example, aluminum alloy or copper. The heat radiator 11 can be provided with irregularities or fins over the surface to increase the surface area so that heat radiation efficiency can be improved.

Figure 3:
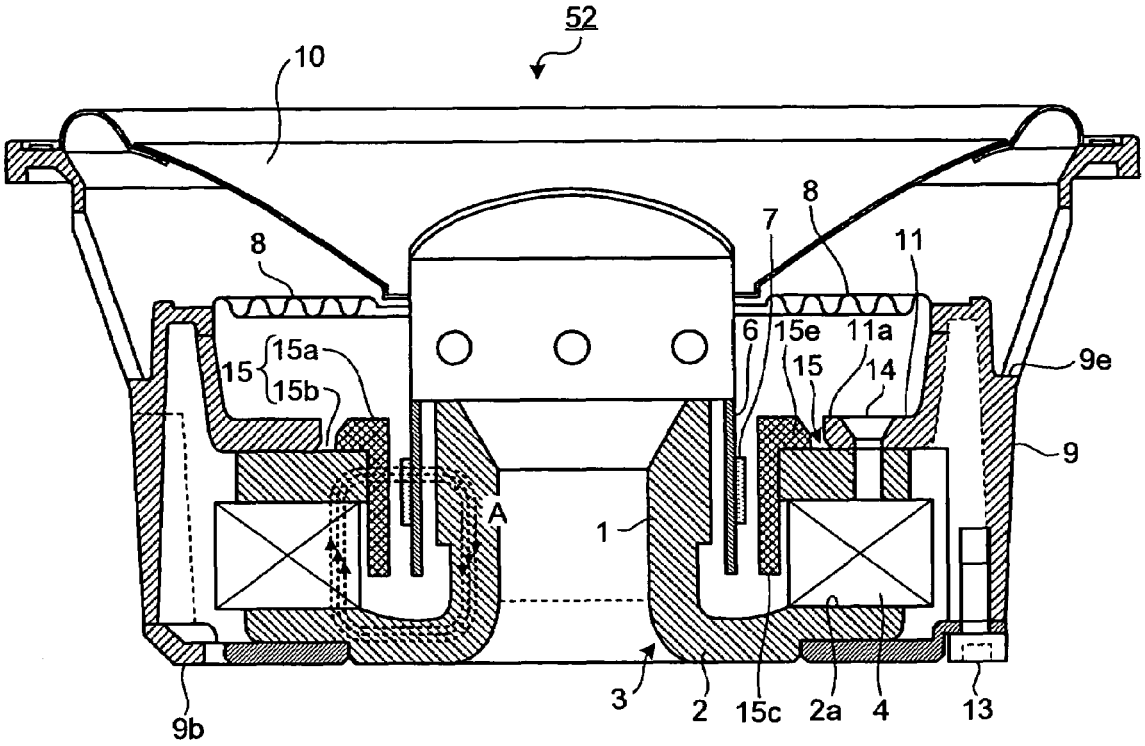
FIG. 3 is a vertical cross-section of a speaker apparatus according to a second example of the present invention.
Figure 4:
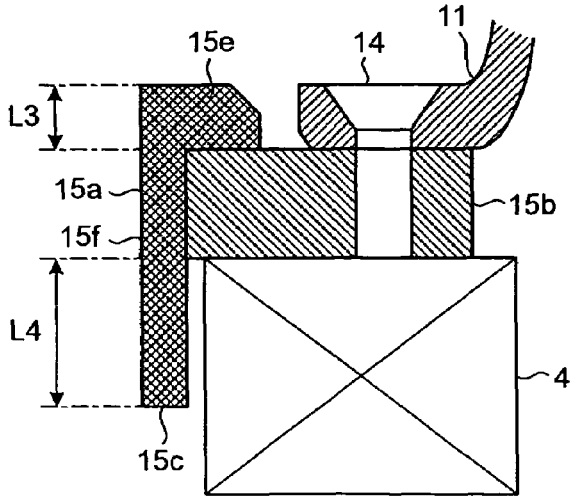
FIG. 4 is an enlarged view adjacent to a top plate of the speaker apparatus in FIG. 3.

FIG. 3 is a vertical cross-section of a speaker apparatus 52 according to a second example of the present invention. FIG. 4 is an enlarged view of a portion adjacent to a top plate of the speaker apparatus 52. The speaker apparatus 52 includes a top plate that is configured with a first member 15*a* and a second member 15*b*. The first member 15*a* is configured with a cylindrical section 15*c* with a radially uniform thickness, and an engaging section 15*e* that projects circumferentially from the lateral surface all around the cylindrical section 15*c* (outer circumferential surface) toward the second member 15*b* to be engaged with the second member 15*b*. The second member 15*b* forms a disk shape with a radially uniform thickness. A corner of the second member 15*b* adjacent to the inner circumference approaching the diaphragm 10 that has a cross-sectional right angle formed between the inner circumferential surface and a large area surface facing the diaphragm 10 configures an engaging section on the second member 15*b* side that engages the engaging section 15*e* of the first member 15*a*. The both engaging sections are linked mutually to position each other. At the corner, the open side of the second member 15*b* adjacent to the inner circumference is fit to the back surface of the engaging section 15*e* of the first member 15*a* (fitting axially), and the inner circumferential surface is fit to the outer circumferential surface of the first member 15*a* (fitting radially). Other configuration is similar to the first example.

A first length L3, by which the first member 15*a* axially extends from the second member 15*b* toward the diaphragm 10, is shorter than a second length L4, by which the first member 15*a* axially extends from the second member 15*b* away from the diaphragm 10. This attempts to shorten the axial length of the magnetic circuit that generates the magnetic flux A, and consequently to shorten the axial length of the speaker apparatus 52 to reduce its size.

Regarding the first member 15*a* and the second member 15*b*, although the open side adjacent to the inner circumference is fit to the back surface of the engaging section 15*e* of the first member 15*a* (fitting axially), and the inner circumferential surface is fit to the outer circumferential surface of the first member 15*a* (fitting radially), it is difficult to fit two cylindrical members radially in terms of processing work, in general. It is not essential to fit the first member 15*a* and the second member 15*b* radially; magnetically fitting them can be enough. However, it is optimal if the joint surface between the first member 15*a* and the second member 15*b* is jointed with a sufficiently large magnetic surface to avoid diminishing a magnetic path. For this purpose, the axial contact surface and the radial contact surface are preferably jointed such that the both contact surfaces are closely fit, or when a gap is built up to some extent between the both, the gap is preferably filled with a magnetic material or the like.

As described above, in the speaker apparatus 52, the first length L3, by which the first member 15*a* extends from the second member toward the diaphragm 10, is shorter than the second length L4, by which the first member 15*a* extends away from the diaphragm 10. As a result, the axial length of the magnetic circuit that generates the magnetic flux A can be shortened, and consequently the axial length of the speaker apparatus 52 can be shortened to reduce its size.

Furthermore, the first member 15*a* and the second member 15*b* include the engaging sections that are linked mutually to position each other, and this facilitates mutual positioning, reduces assembling work, and makes the apparatus with a high precision in assembling and a high performance.

Figure 5:
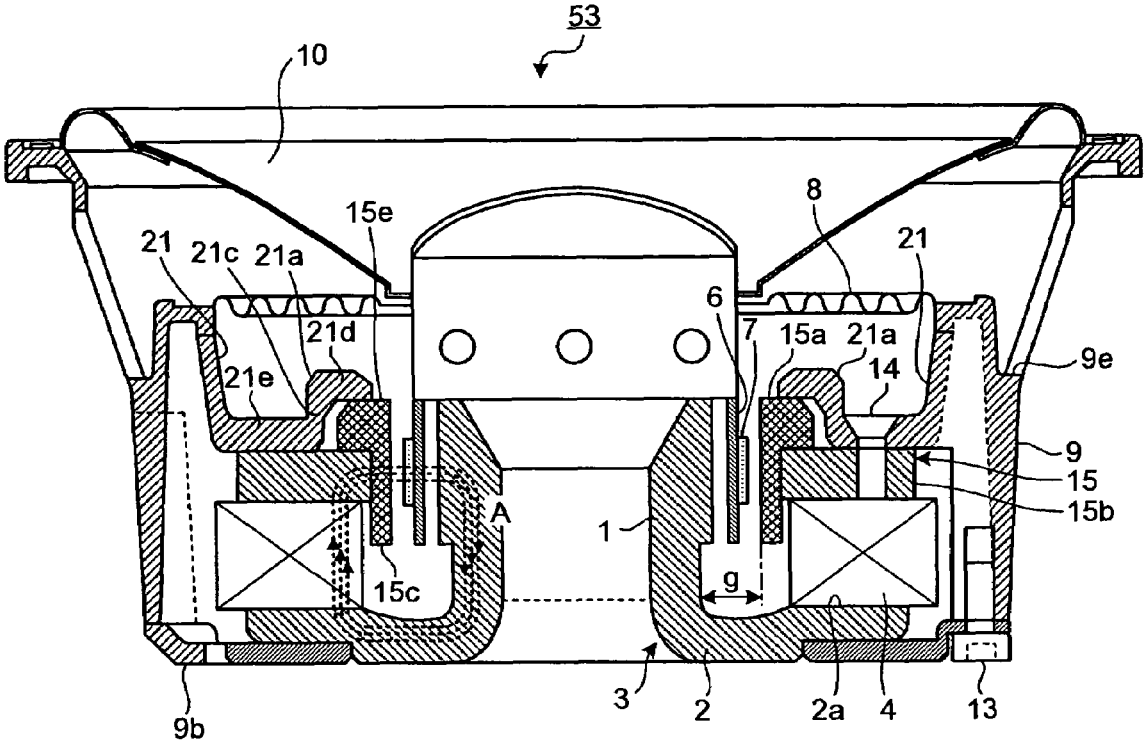
FIG. 5 is a vertical cross-section of a speaker apparatus according to a third example of the present invention.

FIG. 5 is a vertical cross-section of a speaker apparatus 53 according to a third example of the present invention. A heat radiator 21 of the speaker apparatus 53 includes an end surface contact section 21*a* that forms an annular shape with a substantially cranked cross-section arranged in contact with an open end of the top plate 15. In the radially middle part of the end surface contact section 21*a* of the heat radiator 21, a flexion 21*c* with a cranked cross-section is formed all around the circumference. A size of the flexion 21*c* (axial height) is made as almost the same as or slightly smaller than the height of the engaging section 15*e* (axial thickness), such that the flexion 21*c* fastens a step formed by the engaging section 15*e* with a prespecified pressing force.

In an inner circle 21*d* that is an inner part inside the flexion 21*c* of the end surface contact section 21*a* of the heat radiator 21, a plane of the inner circle 21*d* in opposition to the engaging section 15*e* areally contacts an end surface of the engaging section 15*e* facing to the diaphragm 10 by surface to surface. Also in an outer circle 21*e* that is an outer part outside the flexion 21*c* of the end surface contact section 21*a* of the heat radiator 21, a plane of the outer circle 21*e* in opposition to the second member 15*b* areally contacts the main surface of the second member 15*b*.

The outer circle 21*e* is threaded with four thread holes in total at circumferentially regular intervals, which are insertion holes for fastening units. The thread holes are axially perforated. Thread holes are also threaded at opposite positions on the second member 15*b*. The heat radiator 21 is fastened onto the second member 15*b* with the bolts 14 that are fastening units inserted into the thread holes.

As described above, in the speaker apparatus 53, the heat radiator 21 is also a securing member that secures the first member 15*a* and the second member 15*b* each other. Therefore, no additional securing member needs to be provided, so that the number of parts can be reduced and a cost reduction can be achieved.

Figure 6:
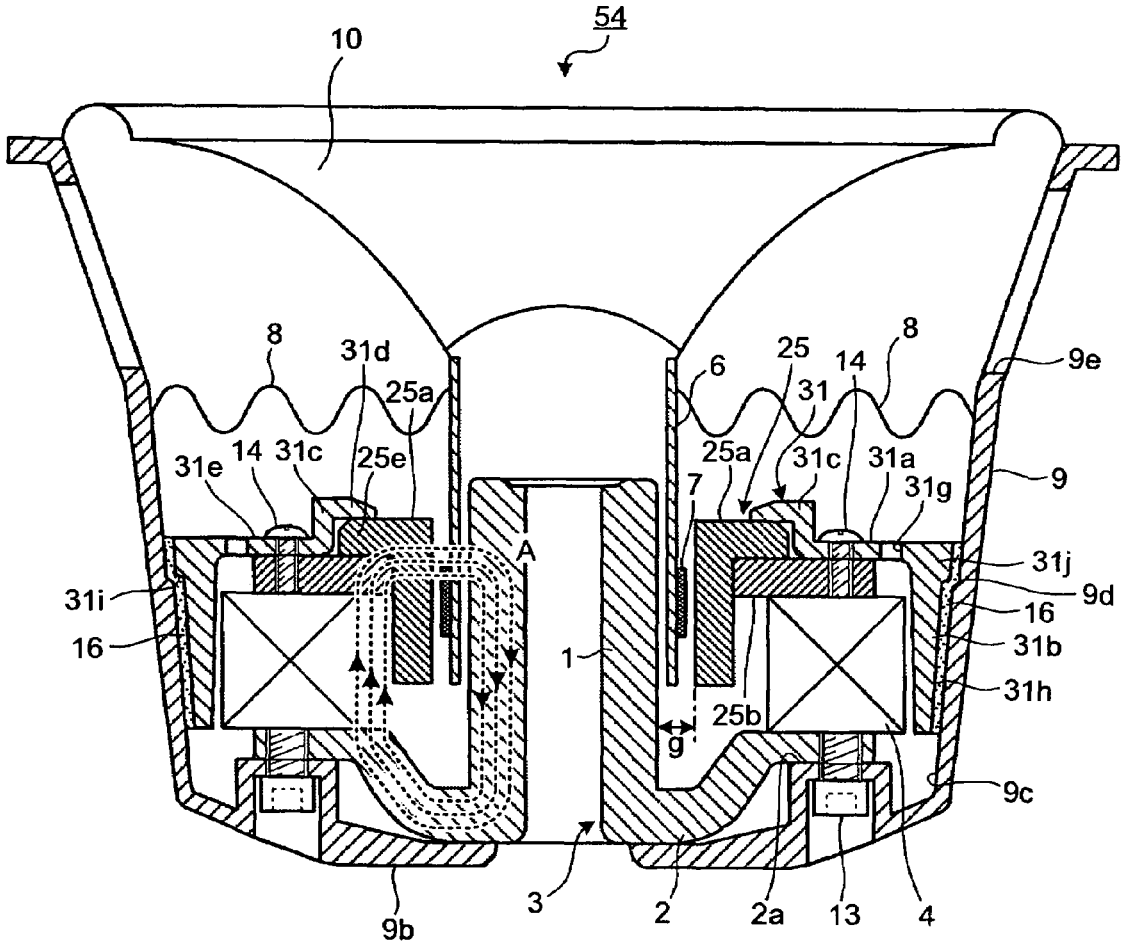
FIG. 6 is a vertical cross-section of a speaker apparatus according to a fourth example of the present invention

FIG. 6 is a vertical cross-section of a speaker apparatus 54 according to a fourth example of the present invention. A top plate 25 of the speaker apparatus 54 is configured with a first member 25*a* that forms a thin cylindrical shape with a large diameter having a flange outwardly extending at an opening facing to the diaphragm 10 and has an L-shaped radial cross-sectional profile, and a second member 25*b* that forms a thin flat ring shape and has an elongate rectangular shape as its radial cross-sectional profile.

An engaging section 25*e* formed of a flange of the first member 25*a* forms one of steps on an open end surface of the second member 25*b*. On a further side of the top plate 25 closer to the diaphragm 10, arranged is a heat radiator 31 made from aluminum, which has high thermal conductivity and is a nonmagnetic material. The heat radiator 31 is made from a nonmagnetic material to avoid disturbing the magnetic circuit. The heat radiator 31 is configured by integrally forming an end surface contact section 31*a*, which forms an annular shape with a substantially cranked cross-section arranged in contact with an open end of the top plate 25, and a frame contact section 31*b*, which has a substantially cylindrical shape and extends downward from a peripheral edge 31*j* of the end surface contact section 31*a* along the inner surface of the frame 9. In the radially middle part of the end surface contact section 31*a* of the heat radiator 31, a flexion 31*c* with a cranked cross-section is formed all around the circumference. A size of the flexion 31*c* (axial height) is made as almost the same as or slightly smaller than the height of the engaging section 25*e* (axial thickness) such that the flexion 31*c* matches with the step formed on the open end surface of the top plate 25.

In an inner circle 31*d* that is an inner part inside the flexion 31*c* of the end surface contact section 31*a* of the heat radiator 31, a plane of the inner circle 31*d* in opposition to the engaging section 25*e* areally contacts an end surface of the engaging section 25*e* facing to the diaphragm 10 by surface to surface. Also in an outer circle 31*e* that is an outer part outside the flexion 31*c* of the end surface contact section 31*a* of the heat radiator 31, a plane of the outer circle 31*e* in opposition to the second member 25*b* areally contacts the main surface of the second member 25*b*.

The outer circle 31*e* is threaded with four thread holes in total at circumferentially regular intervals, which are insertion holes for fastening units. The thread holes are axially perforated. Thread holes are also threaded at opposite positions on the second member 25*b*. The heat radiator 31 is fastened onto the second member 25*b* with the bolts 14 that are fastening units inserted into the thread holes. Vents 31*g* are bored by eight in total at circumferentially regular intervals between the outer circle 31*e* and the frame contact section 31*b*. The vents 31*g* are shaped in arc-like ellipses along the circumference. The vents 31*g* ventilates between the outside space and a substantially closed space formed by the top plate 25, the heat radiator 31, and the frame 9. The ring magnet 4 is accommodated in the closed space.

The frame contact section 31*b* and the frame 9 are secured with an adhesive 16. The adhesive 16 that has high thermal conductivity is desirable. An outer circumferential surface 31*h* of the frame contact section 31*b* that extends downward from the peripheral edge 31*j* of the heat radiator 31 along the inner surface of the frame 9 areally contacts an inner circumferential surface 9*c* of the frame 9 over a large area via the adhesive 16. A positioning engaging section 31*i* formed at an edge of the outer circumferential surface 31*h* facing to the diaphragm 10 engages with an engaging step 9*d* formed all around the inner circumferential surface 9*c* of the frame 9 to position the heat radiator 31 at a prespecified position with respect to the frame 9.

As described above, in the speaker apparatus 54, the external diameter of the engaging section 25*e* of the first member 25*a* is smaller than the external diameter of the second member 25*b*. As a result, a step is formed on the surface of the top plate 25 away from the ring magnet 4, the heat radiator 31 is formed with the flexion 31*c* on its radially middle part all around the circumference. The flexion 31*c* engages with a step formed by the engaging section 25*e* of the first member 25*a* and the second member 25*b*. This configuration allows a larger contact area between the heat radiator 31 and the top plate 25, and enhancement of a thermal connection, so that more heat can be absorbed more efficiently. The heat radiator 31 flexes and covers the surface of the top plate 25 so as to follow along the steps of the top plate 25, so that a wider area can be covered efficiently with less materials to reduce costs. In addition, by engaging the flexion 31*c* with the steps, assembling rigidity between the first member 25*a* and the second member 25*b* can be improved.

Furthermore, the heat radiator 31 includes the inner circle 31*d* that is provided on the inner part inside the flexion 31*c* and areally contacts the engaging section 25*e* of the first member 25*a*, and the outer circle 31*e* that is provided on the outer part outside the flexion 31*c* and areally contacts the second member 25*b*. The outer circle 31*e* is fastened on to the second member 25*b* with the bolts 14 that are fastening units perforating in a direction of intersecting the contact surface.

As a result, the contact area is surely increased, and as fastening force acts on the outer circle 31*e* of the heat radiator 31 with the bolts 14 in the direction of layers, the contact surface of the outer circle 31*e* is surely fit to the second member 25*b* with the fastening force, so that thermal connection is enhanced. Moreover, as the fastening force is conducted to the inner circle 31*d* linked to the outer circle 31*e* via the flexion 31*c*, the contact surface of the inner circle 31*d* is surely fit to the engaging section 25*e* of the first member 25*a*, so that thermal connection is further enhanced. Furthermore, the first member 25*a* is tightly held between the inner circle 31*d* and the second member 25*b* with the fastening force, so that assembly rigidity between the first member 25*a* and the second member 25*b* is further improved. The fastening force can be adjusted by controlling a degree of tightening the bolts 14. Therefore, a degree of tightening the bolts 14 can be changed individually, or all of the bolts 14 can be firmly tightened to force the top plate 25 to fit to the heat radiator 31, whereby, for example, deformation of the top plate 25 can be rectified.

Moreover, the heat radiator 31 is formed with the vents 31*g* bored through that ventilate between the outside space and the inside space of the heat radiator 31. Because the heat radiator 31 extends until it contacts the frame 9, the space where the ring magnet 4 and the top plate 25 are arranged is a substantially closed space by the heat radiator 31. However, the heat radiator 31 is bored through with the vents 31*g*, so that air convection occurs between the inside and the outside of the heat radiator 31 via the vents 31*g*. As a result, heated air escapes to the outside of the heat radiator 31, heat can be released more efficiently.

Moreover, the peripheral edge 31*j* of the heat radiator 31 is thermally connected to the frame 9, so that the heat radiator 31 conducts heat absorbed from the top plate 25 to the frame 9, to release it from the frame 9 to the outside. Thereby, heat radiation efficiency is further improved.

Furthermore, in the peripheral edge 31*j* of the heat radiator 31, the frame contact section 31*b* is formed, which is built so as to extend along the inner circumferential surface of the frame 9 keeping thermal connection with the frame 9. As a result, a sufficient contact area can be obtained to conduct heat between the heat radiator 31 and the frame 9. This prevents heat from stagnating in the heat radiator 31, so that thermal efficiency is further improved.

In addition, in the frame 9, an opening 9*e* is formed, which ventilates between the inside space of the frame 9 and the outside space. As a result, heated air does not stagnate within the frame 9, so that thermal efficiency is further improved.

Moreover, on the inner circumferential surface of the frame 9, the engaging step 9*d* to be engaged to the peripheral edge 31*j* of the heat radiator 31 is continuously formed all around the circumference. As a result, the heat radiator 31 is positioned at a prespecified position with respect to the frame 9. This facilitates assembly work as well as improves accuracy of positioning to allow the apparatus to have high performance, and assembling rigidity is enhanced and durability is improved.

Although the heat radiator 31 is fastened with the bolts 14 inserted into thread holes formed on the second member 25*b*, it is not limited to by means of fastening units such as bolts, but also it can be secured onto the second member 25*b* with an adhesive. Or, the both first and second members 25*a* and 25*b* can be secured with an adhesive. Alternatively, the bolts 14 and an adhesive can be used in combination.

Figure 7:
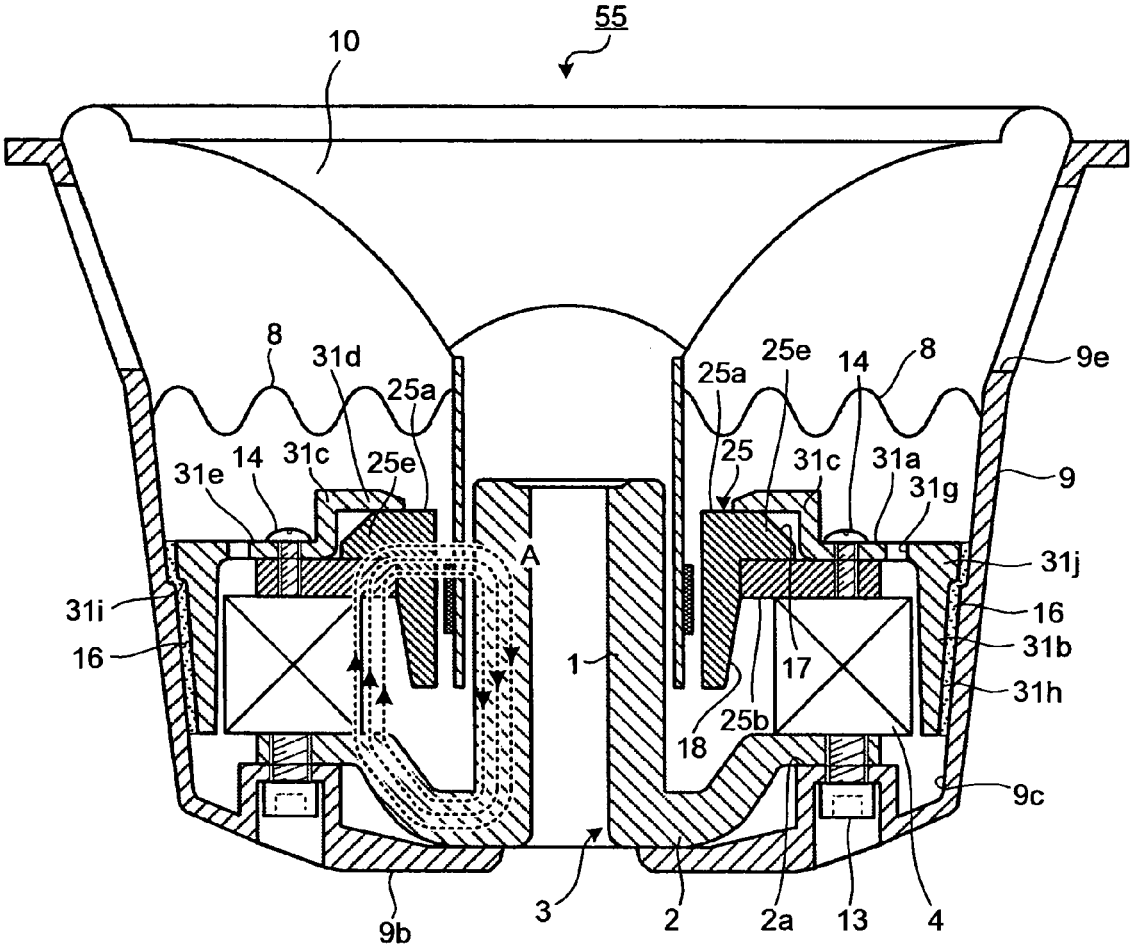
FIG. 7 is a vertical cross-section of a speaker apparatus according to a fifth example of the present invention.

FIG. 7 is a vertical cross-section of a speaker apparatus 55 according to a fifth example of the present invention. In the speaker apparatus 55, a slope 17 is formed on the outer circumference of the engaging section 25*e* of the first member 25*a*. A slope 18 is formed on an extremity of the first member 25*a*. The slope 17 is formed such that the engaging section 25*e* gradually reduces its thickness outward in the radial direction. The slope 18 is formed such that the first member 25*a* gradually reduces its thickness as it departs from the second member 25*b* toward the opposite direction to the diaphragm 10. Thus, on the engaging section 25*e* of the first member 25*a*, formed is a cross-sectionally tapering section that gradually reduces its thickness outward in the radial direction. An extension that the first member 25*a* extends with respect to the second member 25*b* axially away from the diaphragm 10 is a cross-sectionally tapering section that gradually reduces its thickness toward its end. This configuration reduces materials to decrease costs and allows the apparatus to be lightened.

The first to fifth examples relate to the external magnet speaker apparatus in which a permanent magnet is arranged radially outside the voice coil. However, the present invention can be similarly applied to the internal magnet type speaker apparatus.

Figure 8:
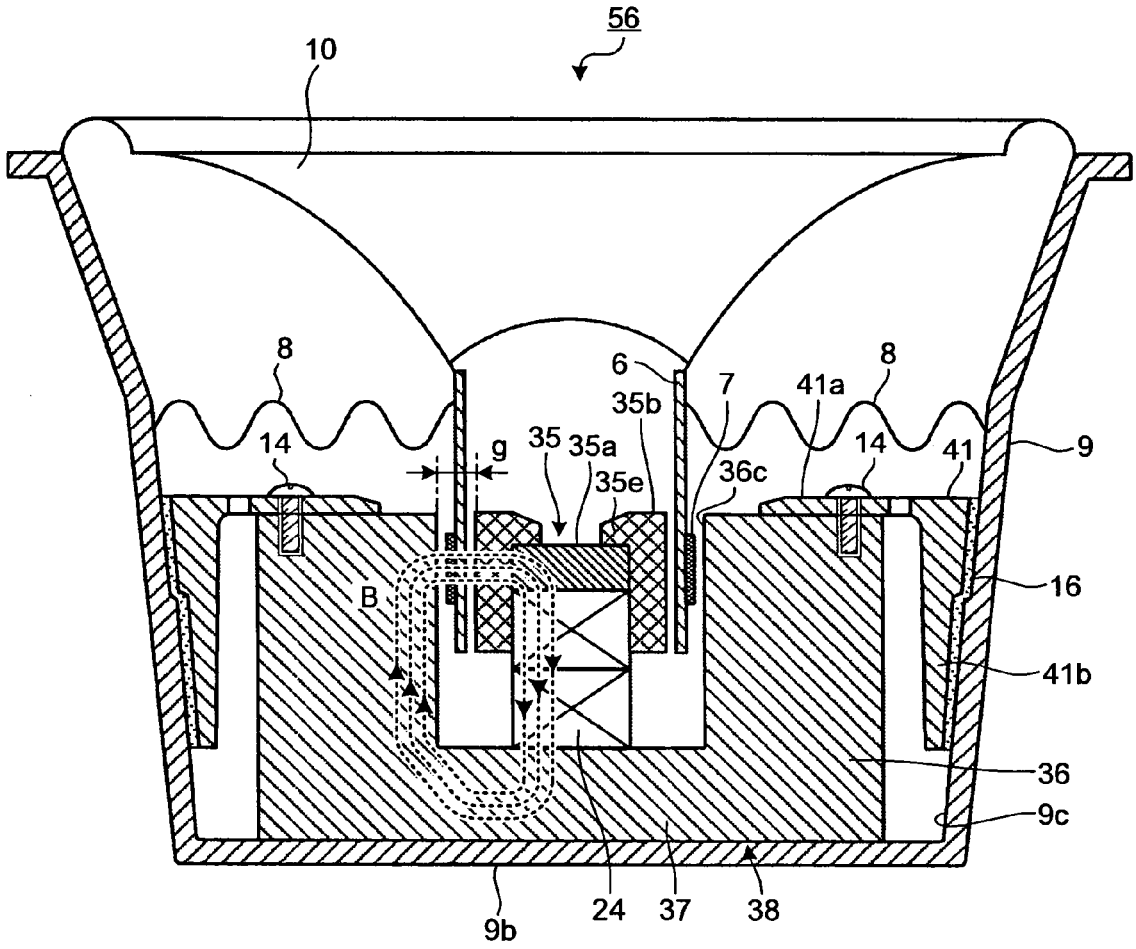
FIG. 8 is a vertical cross-section of a speaker apparatus according to a sixth example of the present invention.

FIG. 8 is a vertical cross-section of a speaker apparatus 56 according to a sixth example of the present invention. The speaker apparatus 56 includes a magnetic circuit that generates magnetic flux B (indicated with broken lines only in the left side in FIG. 6). The magnetic circuit is configured with two center magnets 24 that are permanent magnets provided in the center of the speaker apparatus 56, a top plate 35 that is composed of two members provided as superposed on the center magnets 24, and a yoke 38 in a cylindrical shape with a bottom that internally accommodates the center magnets 24 and the top plate 35. The yoke 38 is configured with a cylindrical outer yoke 36 and a bottom yoke 37 that forms a bottom. In the magnetic circuit, the top plate 35 configures an inner flux applicator, while the outer yoke 36 configures an outer flux applicator. The magnetic circuit generates the magnetic gap g between the outer circumferential surface of the top plate 35 and an inner circumferential surface 36*c* of the outer yoke 36.

The center magnets 24 are permanent magnets in a short, thick cylindrical shape, and two of them are provided as superposed in the center of the speaker apparatus 56. On a side of the center magnets 24 facing to the diaphragm 10, the top plate 35 made from a magnetic material, such as iron, is secured with a magnetic adhesive. The center magnets 24 and the top plate 35 are accommodated inside the yoke 38 in a thick, cylindrical shape with a bottom.

The top plate 35 is configured with a first member 35*a* and a second member 35*b*. The first member 35*a* is placed directly on the center magnets 24 to form a disk shape. On the other hand, the second member 35*b* forms a substantially thin cylindrical shape having a flange inwardly extending at an opening facing to the diaphragm 10. The inward flange configures an engaging section 35*e* that engages the first member 35*a*.

On a side of the outer yoke 36 facing to the diaphragm 10, arranged is a heat radiator 41 made from aluminum, which has high thermal conductivity and is a nonmagnetic material. The heat radiator 41 is made from a nonmagnetic material to avoid disturbing the magnetic circuit. The heat radiator 41 is configured by integrally forming an end surface contact section 41*a*, which has a thin ring shape and is provided in contact with an open end of the outer yoke 36, and a frame contact section 41*b*, which has a substantially cylindrical shape and extends downward from the peripheral edge of the end surface contact section 41*a* along the inner surface of the frame 9.

The frame contact section 41*b* and the frame 9 are secured with an adhesive 16. The adhesive 16 desirably has high thermal conductivity. The outer circumferential surface of the frame contact section 41*b* that extends downward from the peripheral edge of the heat radiator 41 along the inner surface of the frame 9 areally contacts the inner circumferential surface 9*c* of the frame 9 via the adhesive 16 over a large area.

In the speaker apparatus 56, similarly to the external magnet speaker apparatus, the magnetic gap opposing surface in opposition to the magnetic gap g can be made larger, without increasing materials. A ring magnet opposing surface that can also be magnetically jointed to the ring magnet 4 can be made larger. In addition, dividing into two pieces results in simpler processing, which results into cost reduction.

Figure 9:
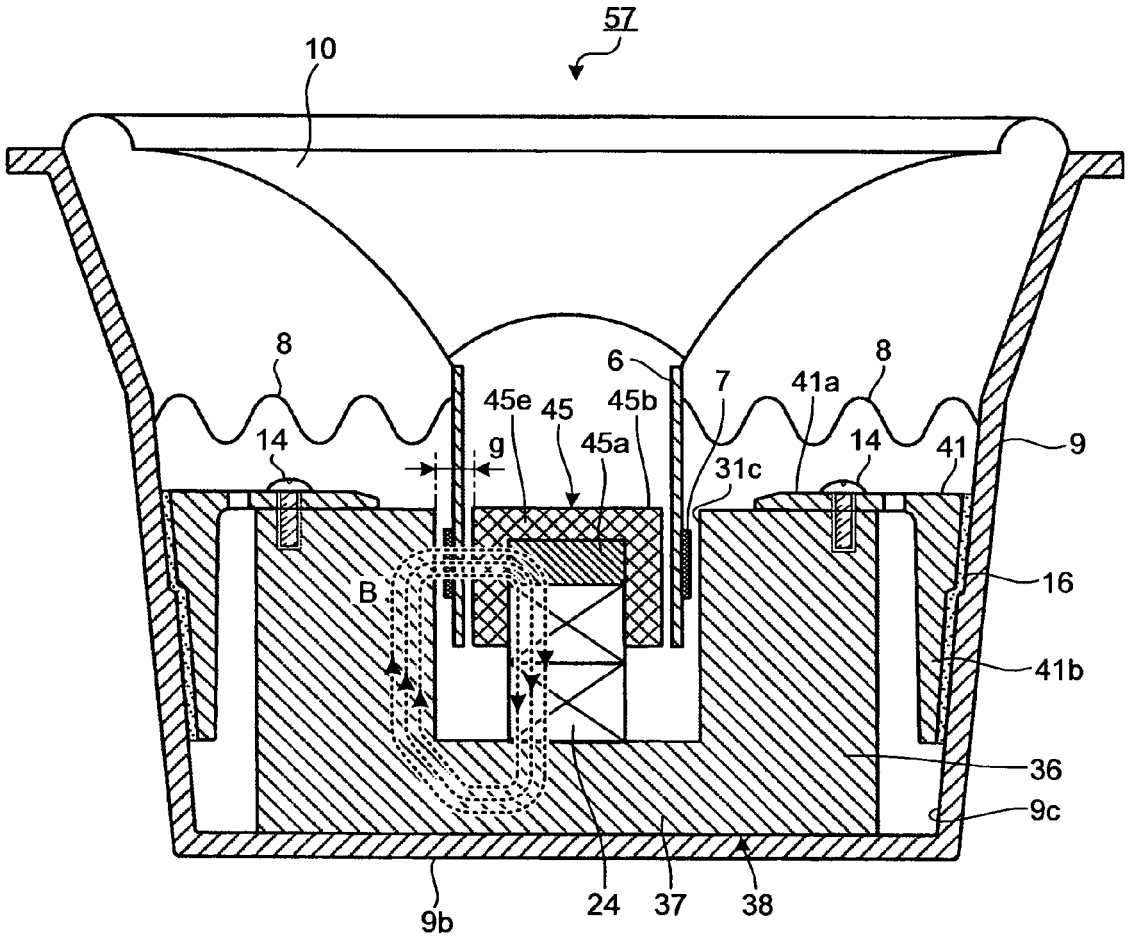
FIG. 9 is a vertical cross-section of a speaker apparatus according to a seventh example of the present invention.

FIG. 9 is a vertical cross-section of a speaker apparatus 57 according to a seventh example of the present invention. A top plate 45 of the speaker apparatus 57 is configured with a first member 45*a* that is directly placed on the center magnets 24 and forms a disk shape, and a second member 45*b* that is provided so as to cover the first member 45*a* and has a cylindrical shape with a bottom. With the speaker apparatus 57, effects can also be obtained substantially similar to those of the speaker apparatus 56 according to the sixth example.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2005-075510, filed Mar. 16, 2005, which is incorporated herein by reference in its entirety.

What is claimed is:

1. A speaker apparatus comprising:

a permanent magnet and a magnetic circuit, the magnetic circuit including an annular inner flux applicator and an annular outer flux applicator, the inner flux applicator and the outer flux applicator being arranged coaxially around a central axis and having a magnetic gap therebetween;

a voice coil arranged in the magnetic gap around the central axis, the voice coil being supported such that the voice coil can vibrate when the inner flux applicator and the outer flux applicator produce magnetic flux in the magnetic gap; and a diaphragm coupled to the voice coil, the diaphragm being supported such that the diaphragm can vibrate when the voice coil vibrates, wherein at least one of the inner flux applicator and the outer flux applicator includes an annular first member having a first surface that faces toward the magnetic gap, the first member satisfying L1>W1 where L1 is a length of the first surface in a direction parallel to the central axis and W1 is a width of the first member in a direction orthogonal to a central axis;

an annular second member that is magnetically coupled with the first member and arranged on an outer side of the first member, the second member satisfying W2>L2 where W2 is a width of the second member in a direction orthogonal to a central axis and L2 is a length of the second surface in a direction parallel to the central axis; and

L1>L2.

2. The speaker apparatus according to claim 1, wherein a first length of a part of the first member extending from the second member toward the diaphragm is shorter than a second length extending away from the diaphragm.

3. The speaker apparatus according to claim 2, wherein at least one of an extension of the first member extending axially from the second member toward the diaphragm and an extension extending from the second member away from the diaphragm is a cross-sectionally tapering section that gradually reduces in thickness towards an end thereof.

4. The speaker apparatus according to claim 1, wherein the first member and the second member have engaging sections that are mutually engaged to position the first member and the second member relative to each other.

5. The speaker apparatus according to claim 4, wherein the second member includes a disk with axially uniform thickness, and the first member includes a cylindrical section with radially uniform thickness and an engaging section projecting from the side of the cylindrical section toward the second member to be engaged with the second member.

6. The speaker apparatus according to claim 5, wherein at least one of the engaging section of the first member and the second member has a cross-sectionally tapering section that gradually reduces in thickness outwards in the radial direction.

7. The speaker apparatus according to claim 4, wherein an outer diameter of the engaging section of the first member is smaller than an outer diameter is formed of the second member, whereby a step section is formed on a surface that is away from the permanent magnet, and the heat radiator having a flexing circumferentially on the middle part in the radial direction and engages the step section formed by the engaging section of the first member and the second member.

8. The speaker apparatus according to claim 7, wherein the heat radiator has an inner part provided on an inner side of the flexion and in contact with the engaging section of the first member by surface and an outer part provided on an outer side of the flexion and in contact with the second member by surface, the outer part being fastened to the second member by a fastening unit penetrating orthogonally to the contact surface.

9. The speaker apparatus according to claim 1, wherein the first member is cylindrical;

the second member is disk-shaped; and

W2>W1.

10. The speaker apparatus according to claim 1, further comprising:

a heat radiator made of a material with high thermal conductivity and thermally coupled with at least one of the first member and the second member.

11. The speaker apparatus according to claim 10, wherein the heat radiator functions as a securing member that secures the first member and the second member to each other.

12. The speaker apparatus according to claim 10, further comprising a frame that accommodates the magnetic circuit, wherein the heat radiator is supported by the frame and is also a securing member that secures at least the second member to the permanent magnet.

13. The speaker apparatus according to claim 12, wherein a peripheral edge of the heat radiator is thermally coupled with the frame.

14. The speaker apparatus according to claim 13, wherein the peripheral edge has a frame contact section extendingly formed so as to expand along an inner surface of the frame.

15. The speaker apparatus according to claim 13, further comprising:

an engaging step section, on the inner surface of the frame, that engages a peripheral edge of the heat radiator.

16. The speaker apparatus according to claim 12, further comprising:

an opening on the frame to allow flow of air in the frame from outside.

17. The speaker apparatus according to claim 10, wherein the heat radiator has vents formed through the heat radiator to allow passage of air in the heat radiator from outside.

18. The speaker apparatus according to claim 1, wherein the inner flux applicator has a long columnar shape, the permanent magnet has an annular shape and is coaxially arranged around the inner flux applicator, and the outer flux applicator coaxially arranged around the inner flux applicator, and the magnetic gap is formed between an outer surface of the inner flux applicator and an inner surface of the outer flux applicator.

19. The speaker apparatus according to claim 18, further comprising a frame configured to accommodate the inner flux applicator, the permanent magnet, and the outer flux applicator, the inner flux applicator having a radial extension that radially extends from a base end, wherein the radial extension is thermally connected to the frame.

20. The speaker apparatus according to claim 1, wherein the permanent magnet is columnar, the inner flux applicator is overlaid on the permanent magnet, and the outer flux applicator is cylindrical and coaxially provided around the inner flux applicator, and the magnetic gap is formed between an outer surface of the inner flux applicator and an inner surface of the outer flux applicator.

* * * * *